United States Patent [19]

Murayama et al.

[11] Patent Number: 4,975,169

[45] Date of Patent: Dec. 4, 1990

[54] DRUM FOR PRODUCING ELECTRODEPOSITED METAL FOIL

[75] Inventors: Kinzo Murayama; Yoshiro Terasawa, both of Joetsu, Japan

[73] Assignee: Nippon Stainless Steel Kozai Co., Ltd., Niigata, Japan

[21] Appl. No.: 503,645

[22] Filed: Apr. 3, 1990

[51] Int. Cl.[5] ..... C25D 17/10
[52] U.S. Cl. ..... 204/216
[58] Field of Search ..... 204/216

[56] References Cited

U.S. PATENT DOCUMENTS 4,240,894 12/1980 Adler ..... 204/208

FOREIGN PATENT DOCUMENTS 58-24507 5/1983 Japan .
61-60149 12/1986 Japan .
62233 1/1987 Japan .

*Primary Examiner*—T. M. Tufariello
*Attorney, Agent, or Firm*—Sughrue, Mion, Zinn, Macpeak & Seas

[57] ABSTRACT

A drum is rotatably immersed as a cathode in an electrolytic solution with an anode placed therein. When a current flow from the anode through the solution to the drum, a metal foil is deposited on the drum as it rotates. The drum includes an electric insulating layer disposed between the outer circumferential surface of an inner drum body and the inner circumferential surface of an outer skin, and an electrically conductive member attached to the outer skin and disposed on one axial end of the inner drum body.

5 Claims, 3 Drawing Sheets

DRUM FOR PRODUCING ELECTRODEPOSITED METAL FOIL

BACKGROUND OF THE INVENTION

1. Field of the Invention

The present invention relates to a drum for producing an electrodeposited metal foil such as a copper foil, an iron foil, a stainless steel foil, or the like on the circumferential surface of the drum.

2. Prior Art

Drums for forming electrodeposited metal foils are disclosed in Japanese Patent Publications Nos. 58(1983)-24507, 61(1986)-60149, and 62(1987)-233, for example.

One conventional drum includes an inner drum body and an outer skin. The outer skin is shrink-fitted over the inner drum body so that they are joined intimately together for reduced contact resistance therebetween. However, the inner circumferential surface of the outer skin cannot be machined to a nicety and tends to have surface irregularities because the outer skin is made of a roled material and has a large diameter. As a result, the outer circumferential surface of the inner drum body and the inner circumferential surface of the outer skin are not uniformly held against each other, but contact each other through surface irregularities. Therefore, a gap or clearance is present between the contacting surfaces of the inner drum body and the outer skin. Because of such a gap, a current which flows across the boundary surface region between the inner drum body and the outer skin during an electrodeposition process is liable to become irregular in intensity in different regions. Owing to the current irregularities, the metal foil deposited on the outer skin suffers thickness irregularities, abnormal metal deposition, and discolored spots known as hot spots due to localized overheating. Accordingly, no large current can be passed through the drum, and hence the metal foil cannot be produced at high speed.

SUMMARY OF THE INVENTION

It is an object of the present invention to provide a drum for producing an electrodeposited metal foil which is free from thickness irregularities, abnormal metal deposition, and hot spots.

Another object of the present invention is to provide a drum for producing an electrodeposited metal foil at an increased speed.

According to the present invention, a drum for producing an electrodeposited metal foil includes an electric insulating layer disposed between the outer circumferential surface of an inner drum body and the inner circumferential surface of an outer skin, and an electrically conductive member attached to the outer skin and disposed on one axial end of the inner drum body.

A current which flows from the outer skin during an electrodeposition process goes directly to the electrically conductive member, but not to the inner drum body across the boundary between the outer skin and the inner drum body.

The above and other objects, features and advantages of the present invention will become more apparent from the following description when taken in conjunction with the accompanying drawings in which preferred embodiments of the present invention are shown by way of illustrative example.

DETAILED DESCRIPTION

Prior to the description of the present invention, a conventional drum for producing an electrodeposited metal foil will first be described with reference to FIGS. 6 and 7.

Figure 6:
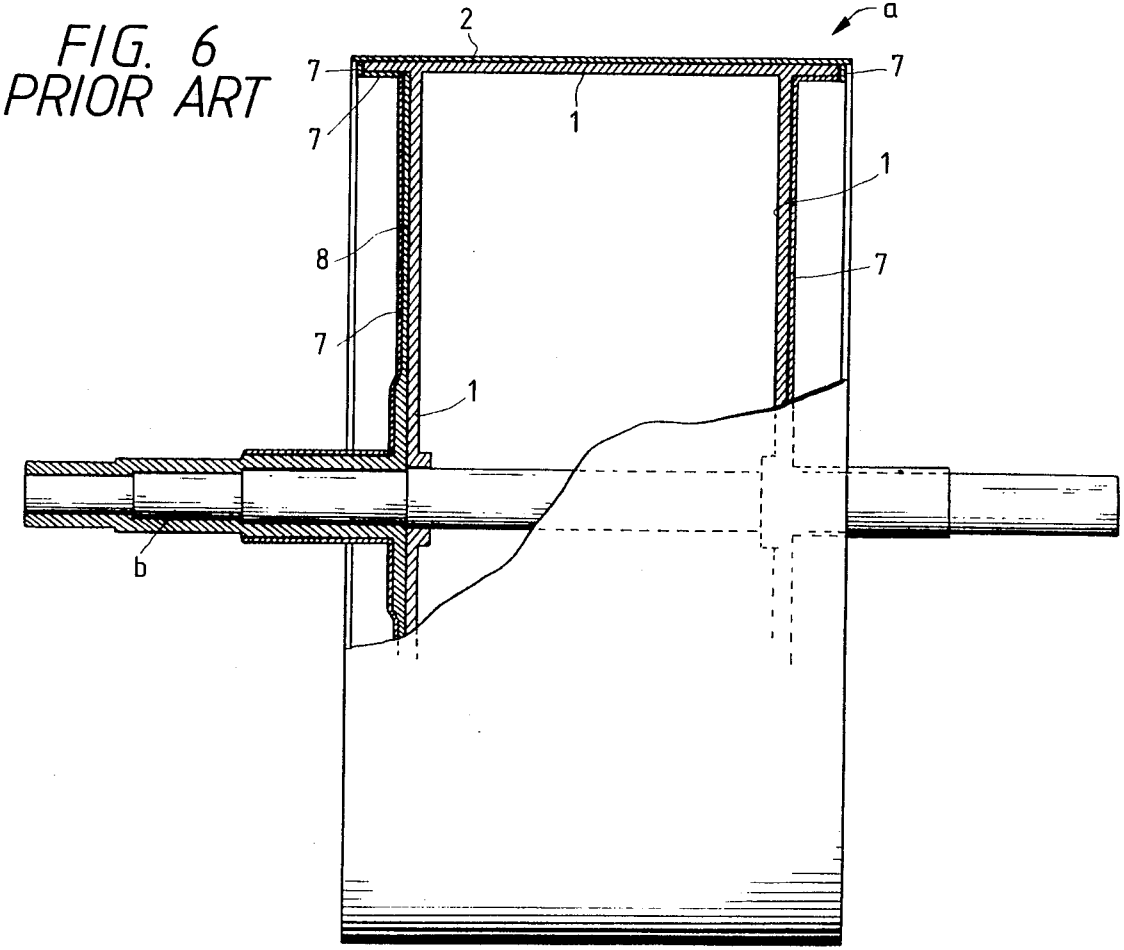
FIG. 6 PRIOR ART
FIG. 6 is a fragmentary cross-sectional view of a conventional drum for producing an electrodeposited metal foil.

As shown in FIG. 6, the drum, generally denoted at a, comprises an inner hollow cylindrical drum body 1 made of carbon steel or the like and an outer hollow cylindrical layer or skin 2 made of titanium or stainless steel, the outer skin 2 being firmly fitted over the outer circumferential surface of the inner drum body 1 with a shrink fit. An electrically conductive layer 8 is disposed on one axial side of the inner drum body 1, and a protective seal 7 is disposed over the opposite axial sides of the inner drum body 1, in covering relation to the conductive layer 8. The protective seal 7 is also attached to radially inner surfaces and axial edges of axially projecting flanges of the inner drum body 1, as better shown in FIG. 7. The drum a is supported on a central shaft b for rotation about its own axis.

In operation, the drum a is partly immersed in an electrolytic solution and rotated about the shaft b. At the same time, an electric current flows from an anode (not shown) placed in the electrolytic solution through the solution to the drum a which serves as a cathode. The current flows in the direction indicated by the arrows R in FIG. 7. Now, a metal layer or foil j is deposited on the outer circumferential surface of the outer skin 2 which is immersed in the electrolytic solution while the drum a is rotating. When the deposited foil j emerges out of the electrolytic solution, it is peeled off the outer skin 2. Therefore, the metal foil j can continuously be manufactured while the drum a is rotating.

The outer skin 2 is shrink-fitted over the inner drum body 1 so that they are joined intimately together for reduced contact resistance therebetween. The outer circumferential surface of the inner drum body 1 is smooth and even since it is machined accurately from a hard material. However, the inner circumferential surface of the outer skin 2 cannot be machined to a nicety and tends to have surface irregularities because the outer skin 2 is made of a rolled material and has a large diameter. As a result, the outer circumferential surface of the inner drum body 1 and the inner circumferential surface of the outer skin 2 are not uniformly held against each other, but contact each other through surface irregularities.

Figure 7:
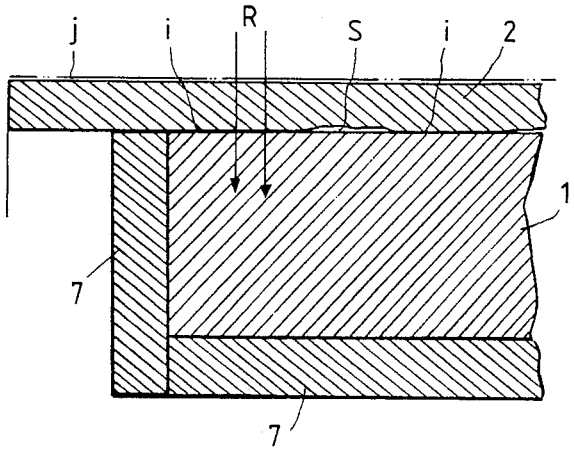
FIG. 7 PRIOR ART
FIG. 7 is an enlarged fragmentary cross-sectional view of a portion of the drum shown in FIG. 6.

As illustrated in FIG. 7, therefore, a gap or clearance S is present between the contacting surfaces of the inner drum body 1 and the outer skin 2. The current which flows across the boundary surface region between the inner drum body 1 and the outer skin 2 in the direction indicated by the arrows R is therefore liable to become irregular in intensity in different regions. Owing to the current irregularities, the deposited metal foil j suffers thickness irregularities, abnormal metal deposition, and discolored spots known a hot spots due to localized overheating. Accordingly, no large current can be passed through the drum a, and hence the metal foil j cannot be produced at high speed.

The present invention will now be described below.

Figure 1:
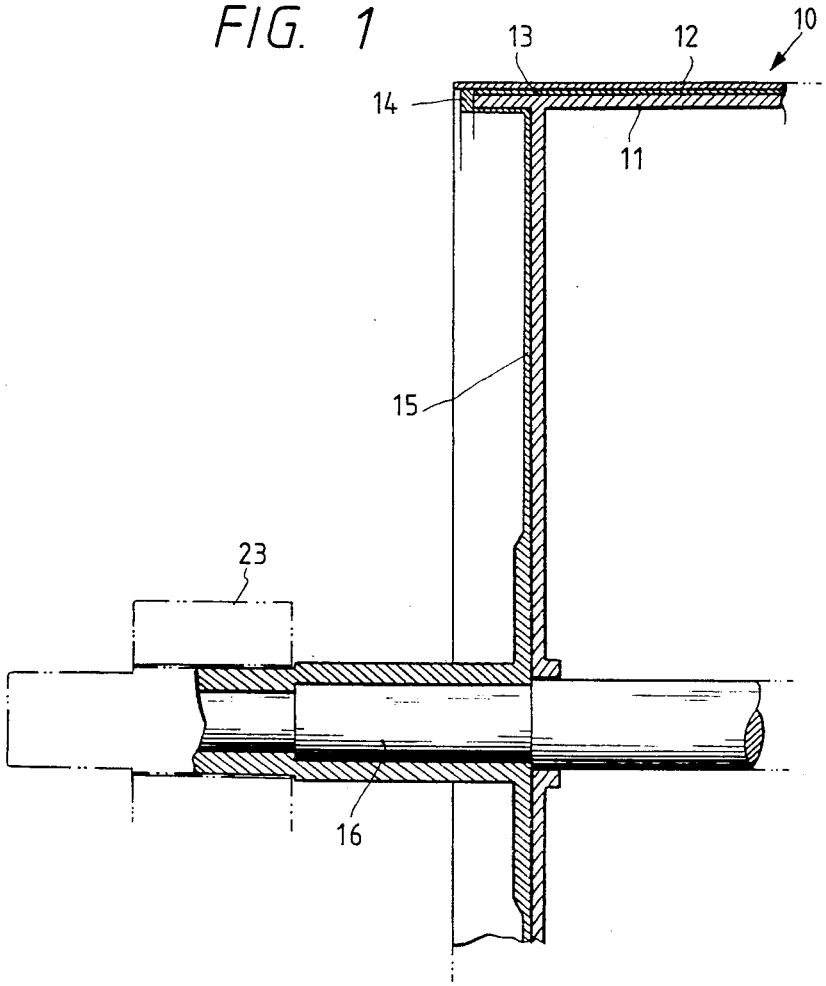
FIG. 1 is a fragmentary cross-sectional view of a drum for producing an electrodeposited metal foil according to an embodiment of the present invention.
Figure 2:
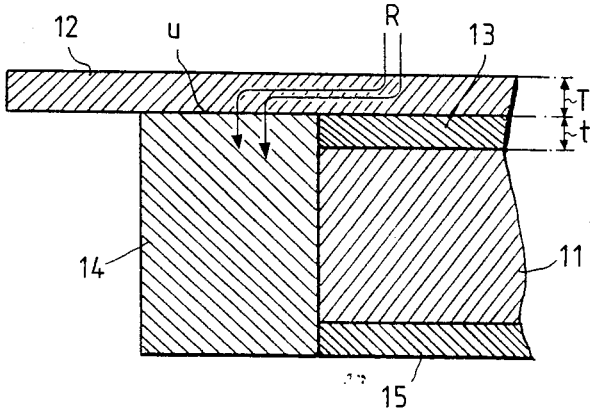
FIG. 2 is an enlarged fragmentary cross-sectional view of a portion of the drum shown in FIG. 1.

FIGS. 1 and 2 show a drum for producing an electrodeposited metal foil according to an embodiment of the present invention. The drum, generally designated by the reference numeral 10, comprises an inner hollow cylindrical drum body 11 made of carbon steel or the like and an outer hollow cylindrical layer or skin 12 made of titanium, stainless steel, tantalum, niobium, zirconium, or an alloy thereof, the outer skin 12 being disposed around the inner drum body 11. An annular electrically conductive member 14 is welded to the inner circumferential surface of one axial end of the outer skin 12. The conductive member 14 is made of titanium, stainless steel, tantalum, niobium, zirconium, or an alloy thereof. The conductive member 14 has an inner axial surface welded to one axial edge of the inner drum body 11. A cylindrical electric insulating layer 13, which is made of FRP, is disposed between the outer circumferential surface of the inner drum body 11 and the inner circumferential surface of the outer skin 12.

The drum 10 is assembled as follows: After the outer circumferential surface of the inner drum body 11 is machined on a lathe, the machined outer circumferential surface is lined with the insulating layer 13. After the insulating layer 13 is solidified, its outer circumferential surface is machined on a lathe. Thereafter, the outer skin 12 is shrink-fitted over the insulating layer 13. More specifically, the outer skin 12 is heated so that it is expanded radially outwardly. The expanded outer skin 12 is fitted over the insulating layer 13, and then cooled so that is contracts on the insulating layer 13. The outer skin 12 has a thickness T of 5.0 mm, for example, and the insulating layer 13 has a thickness t of 3.0 mm, for example.

Thereafter, the conductive member 14 is welded to the inner circumferential surface of one axial end of the outer skin 12 and also to one axial end of the inner drum body 11. Finally, an electrically conductive member 15 is welded to the conductive member 14 and one axial side of the inner drum body 11.

Figure 3:
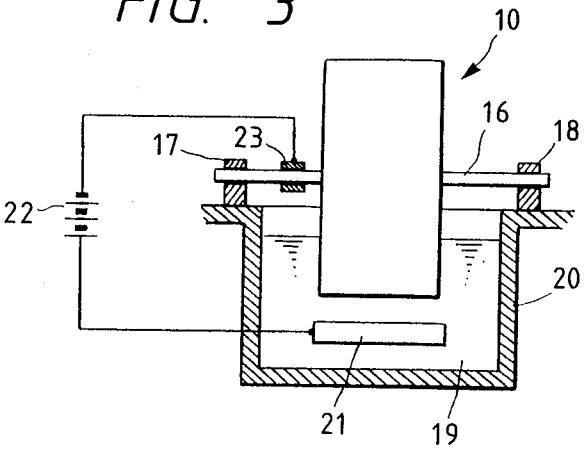
FIG. 3 is a schematic view of an electrodeposition apparatus which employs the drum shown in FIGS. 1 and 2.

The drum 10 is assembled in an electrodeposition apparatus as shown in FIG. 3. The drum 10 is supported on a central shaft 16 which is rotatably supported by a pair of bearings 17, 18 at its opposite ends. The central shaft 16 is coupled to a drive source such as an electric motor (not shown). The drum 10 is partly immersed in an electrolytic solution 19 contained in a tank 20. An anode 21 is placed in the electrolytic solution 19 and electrically connected to the positive terminal of a power supply 22. The negative terminal of the power supply 22 is electrically connected to a current collector ring 23 mounted on the shaft 16.

In operation, a current flows from the anode 21 through the electrolytic solution 19 to the drum 10 while the drum 10 is rotating in the electrolytic solution 19. A metal foil is deposited on the outer skin 12 while it is being immersed in the electrolytic solution 19. When the deposited metal foil emerges out of the electrolytic solution 19, it is peeled off the outer skin 12. As shown in FIG. 2, the current flows from the outer skin 12 to the conductive member 14 in the direction indicated by the arrows R, but does not flow from the outer skin 12 across the insulating layer 13 to the inner drum body 11. Since the current flows from the outer skin 12 directly to the conductive member 14 at one axial end of the outer skin 12, no current irregularities are caused between the outer skin 12 and the inner drum body 11. Therefore, the deposited metal foil is free of the various shortcomings, such as hot spots, which would otherwise result from current irregularities.

Inasmuch as the conductive member 14 is narrow, it can easily be machined and welded, and it is unlikely for any gap or clearance to be created in the welded boundary surface region u (FIG. 2) between the conductive member 14 and the outer skin 12. Even if a gap or clearance is formed in the welded boundary surface region u, it does not adversely affect the deposited metal foil because it is positioned at an end of the foil.

Figure 4:
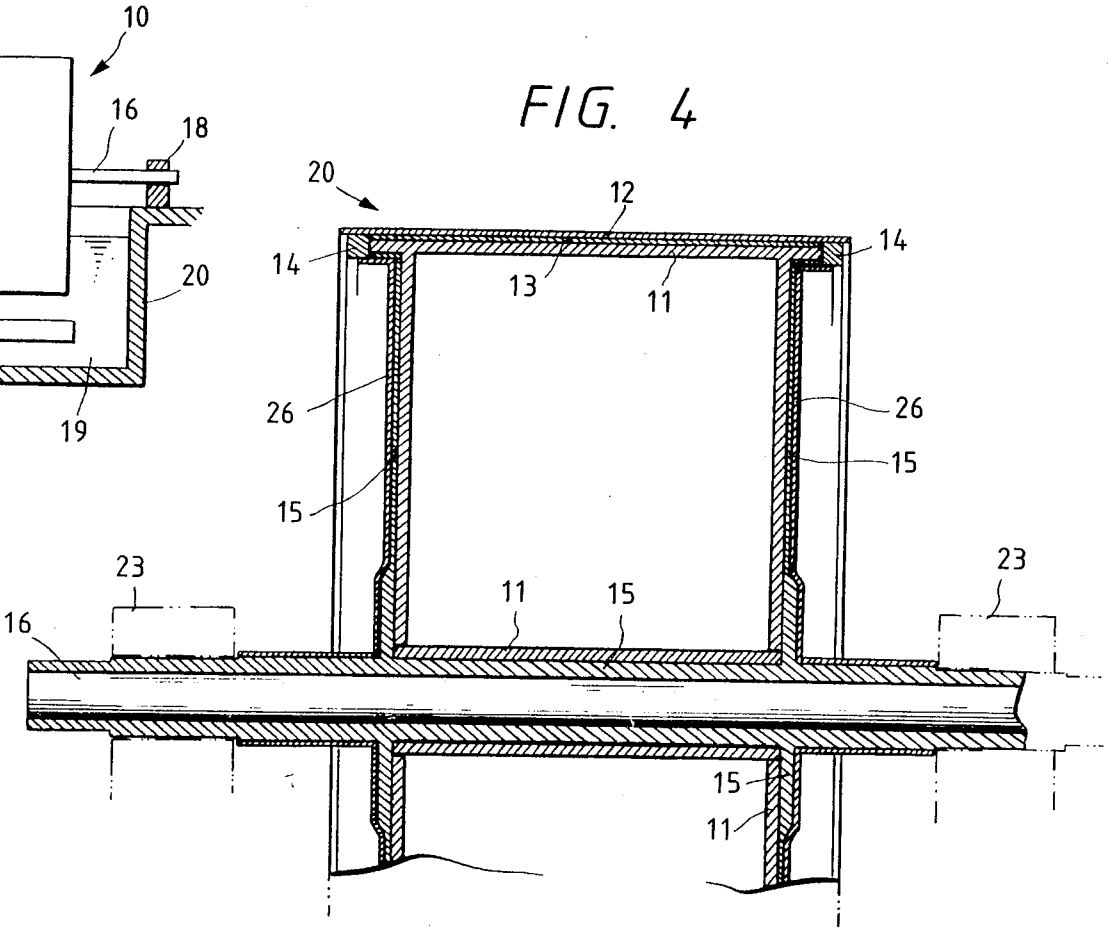
FIG. 4 is a fragmentary cross-sectional view of a drum for producing an electrodeposited metal foil according to another embodiment of the present invention.
Figure 5:
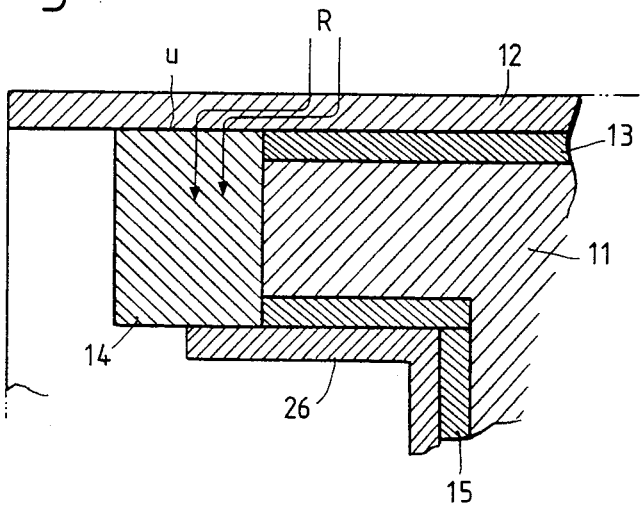
FIG. 5 is an enlarged fragmentary cross-sectional view of a portion of the drum shown in FIG. 4.

FIGS. 4 and 5 show a drum 20 according to another embodiment of the present invention. Those parts shown in FIGS. 4 and 5 which are identical to those shown in FIGS. 1 and 2 will be denoted by identical reference numerals, and will not be described in detail.

The drum 20 differs from the drum 10 shown in FIGS. 1 and 2 in that the conductive members 14, 15 are provided on each axial side of the inner drum body 11 and that a protective conductive member 26 is welded to the conductive members 14, 15 on each axial side of the inner drum body 11. The protective conductive member 26 is made of titanium and serves to prevent the conductive member 14 from being oxidized and also to conduct a current therethrough.

In each of the aforesaid embodiments, the insulating layer 13 may be made of any of various other insulating materials such as a hard resin. The insulating layer 13 may not necessarily extend fully circumferentially around the inner drum body 11, but may be disposed in only local regions on the outer circumferential surface of the inner drum body 11.

Although certain preferred embodiments have been shown and described, it should be understood that many changes and modifications may be made therein without departing from the scope of the appended claims.

What is claimed is:

1. A drum for producing an electrodeposited metal foil thereon, comprising:

an inner drum body;

an outer cylindrical skin disposed around an outer circumferential surface of said inner drum body;

an electric insulating layer disposed between said outer circumferential surface of the inner drum body and an inner circumferential surface of said outer skin; and an electrically conductive member attached to said outer skin and disposed on one axial end of said inner drum body.

2. A drum according to claim 1, wherein said electrically conductive member is of an annular shape and welded to the inner circumferential surface of said outer skin and said axial end of said inner drum body.

3. A drum according to claim 1, wherein said outer skin is shrink-fitted over said electric insulating layer.

4. A drum according to claim 1, further including another electrically conductive member attached to said outer skin and disposed on an opposite axial end of said inner drum body.

5. A drum according to claim 4, further including a protective conductive member welded to each of said electrically conductive members.

* * * * *